US009622524B2

(12) United States Patent
VanErmen et al.

(10) Patent No.: US 9,622,524 B2
(45) Date of Patent: Apr. 18, 2017

(54) BREATHABLE COATED AND PERFORATED GLOVES

(71) Applicant: Performance Fabrics, Inc., Grand Rapids, MI (US)

(72) Inventors: Steven R. VanErmen, Grand Rapids, MI (US); Ronald D. Henion, Middleville, MI (US)

(73) Assignee: Performance Fabrics, Inc., Grand Rapids, MI (US)

( * ) Notice: Subject to any disclaimer, the term of this patent is extended or adjusted under 35 U.S.C. 154(b) by 779 days.

(21) Appl. No.: 13/926,251

(22) Filed: Jun. 25, 2013

(65) Prior Publication Data

US 2013/0283864 A1 Oct. 31, 2013

Related U.S. Application Data

(63) Continuation-in-part of application No. 13/015,009, filed on Jan. 27, 2011, now abandoned.

(60) Provisional application No. 61/299,003, filed on Jan. 28, 2010.

(51) Int. Cl.
*A41D 19/01* (2006.01)
*A41D 19/015* (2006.01)

(52) U.S. Cl.
CPC . *A41D 19/01505* (2013.01); *A41D 19/01558* (2013.01); *A41D 2400/20* (2013.01)

(58) Field of Classification Search
CPC ..... A41D 19/01505; A41D 19/01558; A41D 19/01547; A41D 19/01582
See application file for complete search history.

(56) References Cited

U.S. PATENT DOCUMENTS

| | | | |
|---|---|---|---|
| 1,725,065 | A | 8/1929 | Edwards |
| 3,879,764 | A | 4/1975 | Weber-Liel |
| 4,001,895 | A | 1/1977 | Cohen |
| 4,094,014 | A | 6/1978 | Schroeder |
| 4,224,692 | A | 9/1980 | Sundberg |
| 4,454,611 | A | 6/1984 | Tschirch et al. |
| 4,497,072 | A | 2/1985 | Watanabe |
| 4,559,646 | A | 12/1985 | Ertl |
| 5,070,540 | A | 12/1991 | Bettcher et al. |
| 5,119,512 | A | 6/1992 | Dunbar et al. |
| 5,550,346 | A | 8/1996 | Andriash et al. |
| 5,625,900 | A | 5/1997 | Hayes |
| 5,853,863 | A | 12/1998 | Kim |
| 5,906,873 | A | 5/1999 | Kim |
| 6,044,493 | A | 4/2000 | Post |
| 6,159,590 | A | 12/2000 | Kim |

(Continued)

*Primary Examiner* — Shaun R Hurley
*Assistant Examiner* — Andrew W Sutton
(74) *Attorney, Agent, or Firm* — Price Heneveld LLP

(57) ABSTRACT

A protective glove including a knit fabric hand shell having a cuff portion and a hand portion that includes a back side opposite a palm side for covering opposing sides of a user's hand. A polymeric coating covers the palm side of the hand portion and has a thickness that gradually diminishes from the palm side to the back side of the hand portion. The back side of the hand portion has an area that is free of the polymeric coating to provide ventilation to the user's hand through the knit fabric hand shell. A plurality of perforations is uniformly dispersed over the palm side of the hand portion. The perforations have a diameter less than 0.2 mm and extend though the polymeric coating to provide ventilation to the user's hand and to increase a coefficient of friction for an exterior surface of the polymeric coating.

8 Claims, 8 Drawing Sheets

(56) References Cited

U.S. PATENT DOCUMENTS

| | | | |
|---|---|---|---|
| 6,912,731 | B2 | 7/2005 | Cass |
| 6,962,739 | B1 | 11/2005 | Kim et al. |
| 7,018,692 | B2 | 3/2006 | Kim et al. |
| 7,504,145 | B2 | 3/2009 | Vance et al. |
| 2004/0192133 | A1 | 9/2004 | Kim et al. |
| 2007/0212965 | A1 | 9/2007 | Smith et al. |
| 2008/0206526 | A1 | 8/2008 | Kim et al. |
| 2008/0235850 | A1 | 10/2008 | Cabauy et al. |
| 2008/0282455 | A1 | 11/2008 | Jones et al. |
| 2009/0007313 | A1 | 1/2009 | Boorsma et al. |
| 2009/0126074 | A1 | 5/2009 | Mattesky |
| 2009/0142535 | A1 | 6/2009 | Kim et al. |
| 2009/0183298 | A1 | 7/2009 | Baacke et al. |
| 2011/0179551 | A1 | 7/2011 | VanErmen |

BREATHABLE COATED AND PERFORATED GLOVES

CROSS-REFERENCE TO RELATED APPLICATION

This application is a continuation-in-part application of U.S. patent application Ser. No. 13/015,009, entitled "BREATHABLE COATED AND PERFORATED GLOVES," filed on Jan. 27, 2011, the entire disclosure of which is hereby incorporated by reference. U.S. patent application Ser. No. 13/015,009 claims priority under 35 U.S.C. §119(e) to, and the benefit of, U.S. Provisional Patent Application No. 61/299,003, entitled "BREATHABLE COATED AND PERFORATED GLOVES," filed on Jan. 28, 2010, the entire disclosure of which is hereby incorporated by reference.

FIELD OF THE INVENTION

The present invention generally relates to coated protective gloves, and more particularly to coated and perfora ted protective gloves and the method of making the same.

BACKGROUND OF THE INVENTION

Protective gloves are commonly used by workers in many industries to prevent or minimize hand injuries. One popular type of protective glove is a knit glove made from yarns of cotton, aramids, Vectran steel wire, fiberglass, HDPE, polycotton, etc. Such knit gloves are often combined with a rubbery coating layer in and around the palm area, to provide grip and also wear resistance. Another popular style of glove are those that are cut and sewn together. These may also contain materials such cotton, aramids, Vectran, steel wire, fiberglass, HDPE, polycotton, etc. These gloves may also have a rubbery coating on the palm or other portion of the glove for an enhanced grip and protection. In some instances, these protective gloves are used in high temperature environments that cause the inside of the glove to become hot and uncomfortable, due to the lack of air circulation, including within the palm area. Prior attempts to provide air circulation on the inside of the glove have compromised protection and grip, such that it is generally desired to provide a glove that improves upon the prior attempt.

SUMMARY OF THE INVENTION

According to one aspect of the present invention, a protective glove includes a knit fabric hand shell having a cuff portion and a hand portion seamlessly knit together. The cuff portion includes an elastic material for providing a secure fit around a user's wrist. The hand portion includes a back side opposite a palm side for covering opposing sides of a user's hand. A polymeric coating covers the palm side of the hand portion and has a thickness that gradually diminishes from the palm side to the back side of the hand portion. The back side of the hand portion has an area that is free of the polymeric coating to provide ventilation to the user's hand through the knit fabric hand shell. A plurality of perforations are uniformly dispersed over the palm side of the hand portion. The perforations have a diameter less than 0.2 millimeters (mm) and extend though the polymeric coating to provide ventilation to the user's hand and to increase a coefficient of friction of an exterior surface of the polymeric coating.

According to another aspect of the present invention, a method of making a protective glove includes an initial step of providing a knit fabric hand shell having a hand portion that includes a back side opposite a palm side for covering opposing sides of a user's hand. Another initial step involves providing a bath of polymeric coating that includes a select one or any combination of nitrile rubber, polyurethane, and PVC. The polymeric coating is applied over the palm side of the hand portion by dipping the knit fabric hand shell into the bath to provide the polymeric coating with a thickness that gradually diminishes from the palm side to the back side of the hand portion. A plurality of perforations are then cut though the polymeric coating on the palm side of the hand portion in a predetermined pattern to provide ventilation to the user's hand and to increase a coefficient of friction of an exterior surface of the polymeric coating for enhanced gripping.

According to yet another aspect of the present invention, a method of making a protective glove includes an initial step of providing a knit fabric hand shell having a cuff portion and a hand portion seamlessly knit together. The cuff portion includes an elastic material configured to provide a secure fit around a wrist of a user and the hand portion includes a back side opposite a palm side for covering opposing sides of a hand of the user. Another initial step includes providing a liquid bath of polymeric material that includes a select one or any combination of nitrile rubber, polyurethane, and PVC. The polymeric material is applied over the palm side of the hand portion by dipping the knit fabric hand shell into the bath to provide a polymeric coating that has a thickness gradually diminishing from the palm side to the back side of the hand portion. The back side of the hand portion has an area that is free of the polymeric coating to provide ventilation to the user's hand through the knit fabric hand shell. A plurality of generally circular perforations is cut though the polymeric coating in a predetermined pattern over the palm side of the hand portion to provide ventilation to the user's hand and to increase a coefficient of friction of an exterior surface of the polymeric coating for enhanced gripping.

According to another aspect of the present invention, a protective glove with a coating on it that covers some portion of the glove, but has holes or perforations through the coating to allow the hand to breathe through the polymer coating thus increasing user comfort is provided. This produces a glove that has significantly better breathability and keeps the hand at a lower temperature and causes less perspiration than existing gloves, but still can provide the necessary abrasion resistance and enhanced gripping ability, subject to the size and pattern of the perforations conforming to the ranges and characteristics as described herein.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figure 1:
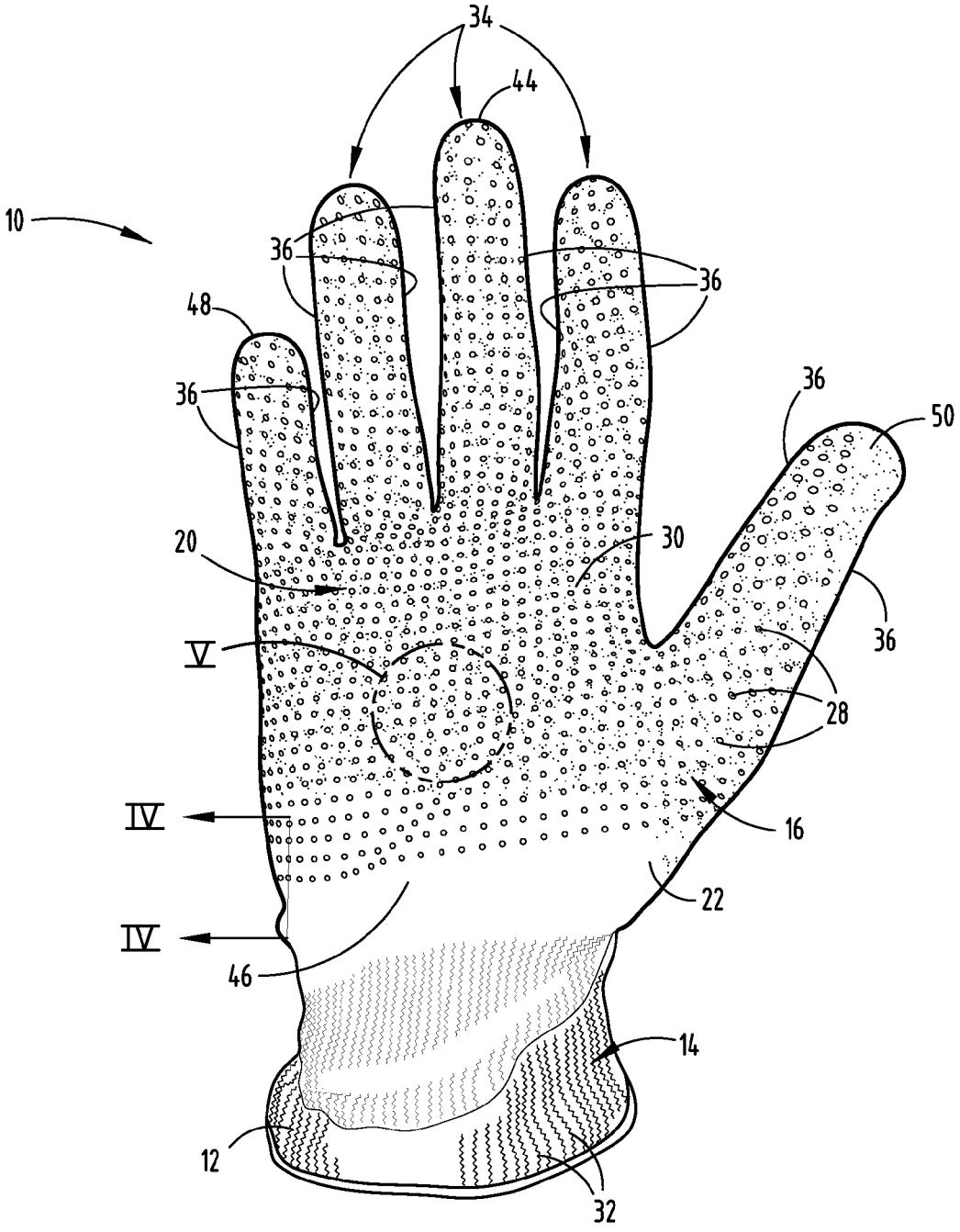
FIG. 1 is a front elevational view of a palm side of a protective glove made in accordance with the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-12, reference numeral 10 generally designates a protective glove that includes a knit fabric hand shell 12 having a cuff portion 14 and a hand portion 16 seamlessly knit together. The cuff portion 14 includes an elastic material for providing a secure fit around a user's wrist. The hand portion 16 includes a back side 18 opposite a palm side 20 for covering opposing sides of a user's hand. A polymeric coating 22 covers the palm side 20 of the hand portion 14 and has a thickness 24 that gradually diminishes from the palm side 20 to the back side 18 of the hand portion 14. The back side 18 of the hand portion 14 has an area 26 that is free of the polymeric coating 22 to provide ventilation to the user's hand through the knit fabric hand shell 12. A plurality of perforations 28 is dispersed over the palm side 20 of the hand portion 14 in a predetermined pattern. The perforations 28 have a diameter less than 0.2 millimeters (mm) and extend though the polymeric coating 22 to provide ventilation to the user's hand and to increase a coefficient of friction of an exterior surface 30 of the polymeric coating 22.

Figure 2:
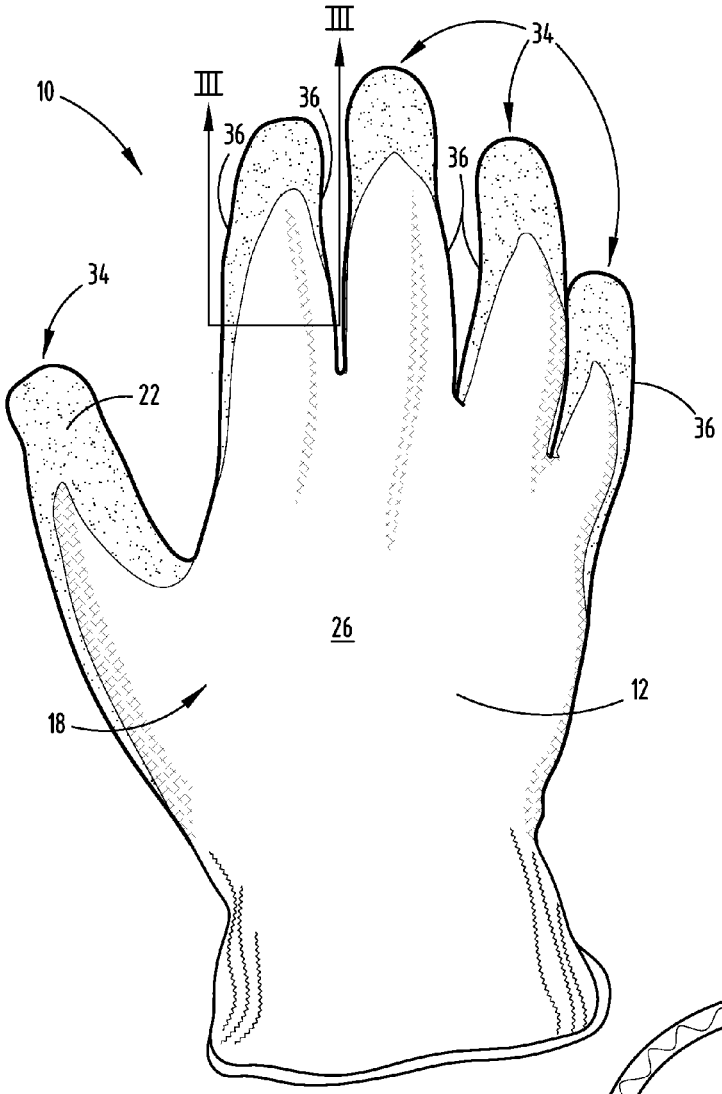
FIG. 2 is a rear elevational view of a back side of the protective glove.

In the embodiment illustrated in FIGS. 1-2, the knit fabric hand shell 12 is entirely knitted using an automatic knitting machine. As such, the cuff portion 14 is seamlessly knit together with the hand portion 16 to substantially eliminate seams on the knit fabric hand shell 12 that can be a source for increased bulk and potential failure during use of the protective glove 10. However, it is conceivable that additional embodiments of the present invention may alternatively include a hand shell 12 that is made by cutting a knitted fabric, a woven fabric, or a combination of knitted and woven fabrics into appropriate sections that are sewn or otherwise affixed together, generally along edges of the cut fabric sections. As shown in FIGS. 1-2, the cuff portion 14 of the knit fabric hand shell 12 includes a series of elastic fibers seamlessly knit to form a ribbed area 32 longitudinally oriented around the cuff portion. The elastic fibers are configured to allow the cuff portion 14 to elastically stretch radially away from a user's wrist and thereby recoil radially inward to securely fit around a user's wrist. It is contemplated that the elastic material may be alternatively incorporated into the cuff portion 14 of the hand shell 12 to provide a secure fit around the user's wrist.

With further reference to the embodiment shown in FIGS. 1-2, the yarns or fibers used to make the knit fabric hand shell 12 includes approximately 96% polyamide (Nylon) and 4% elastic. In other embodiments, the hand shell may also or alternatively include cotton, polyester, elastane, Lycra, polyaramid (Kevlar®), ultra-high molecular weight polyethylene (UHMWPE, Spectra®, Dyneema®), glass, or other high performance fibers. Further, alternative embodiments of the hand shell 10 may include any combination of cotton fibers, aramid fibers, polyurethane fibers, polyamide fibers, high-density polyethylene fibers, ultra high molecular weight polyethylene fibers, and glass fibers. Further, combinations of these fibers may also conceivably include steel fibers and/or fiberglass strands.

Still referring to FIGS. 1-2, the protective glove 10 has a polymeric coating 22 that covers at least the palm side 20 of the hand portion 14. The back side 18 of the hand portion 14 has an area 26 that is free of the polymeric coating 22 to provide ventilation to the user's hand through the knit fabric hand shell 12. The hand portion 14 of the knit fabric hand shell includes a series of fingers 34, namely four fingers and a thumb, that each have a side surface 36 between the palm side 20 and the back side 18. The polymeric coating 22 has a thickness 24 that gradually diminishes from the palm side 20 to the back side 18 of the hand portion 14, providing a decreasing thickness across the side surfaces 36 of the series of fingers 34.

Figure 3:
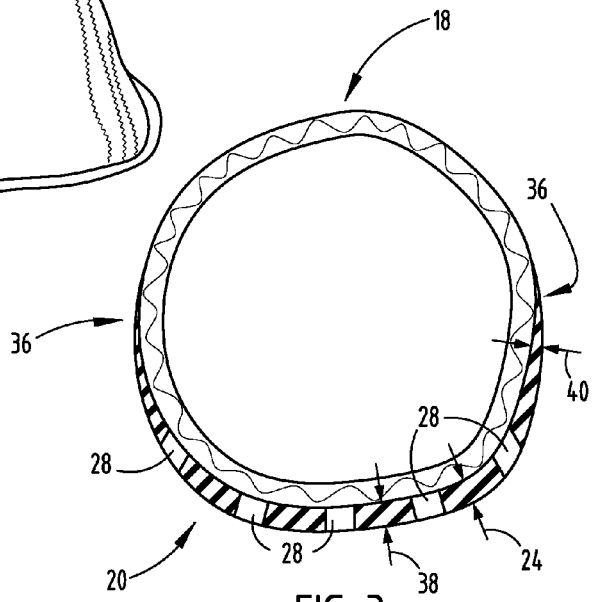
FIG. 3 is a cross sectional view of a finger of the protective glove taken at line III-III of FIG. 2.

As further illustrated in FIG. 3, the thickness of the polymeric coating 22 decreases from a first depth 38 of approximately 0.05 mm proximate the palm side to a second depth 40 of approximately 0.005 mm proximate the side surfaces 36 of the series of fingers 34. The first depth 38 may generally be less than 0.2 mm and more preferably between 0.1 mm and 0.04 mm. Likewise, the second depth 40 may generally be less than 0.01 mm and more preferably between 0.007 and 0.001 mm. In the illustrated embodiment, the thickness 24 of the polymeric coating is formed to decrease proximate the side surfaces 36, such that the second depth 40 of the thickness is provided to allow the series of fingers 34 to slidably move relative to each other with reduced friction. As described in more detail below, the second depth 40 allows some portions of the outermost fibers of the knit fabric hand shell 12 to be exposed, which results in a decreased coefficient of friction on the side surface 36.

Figure 4:
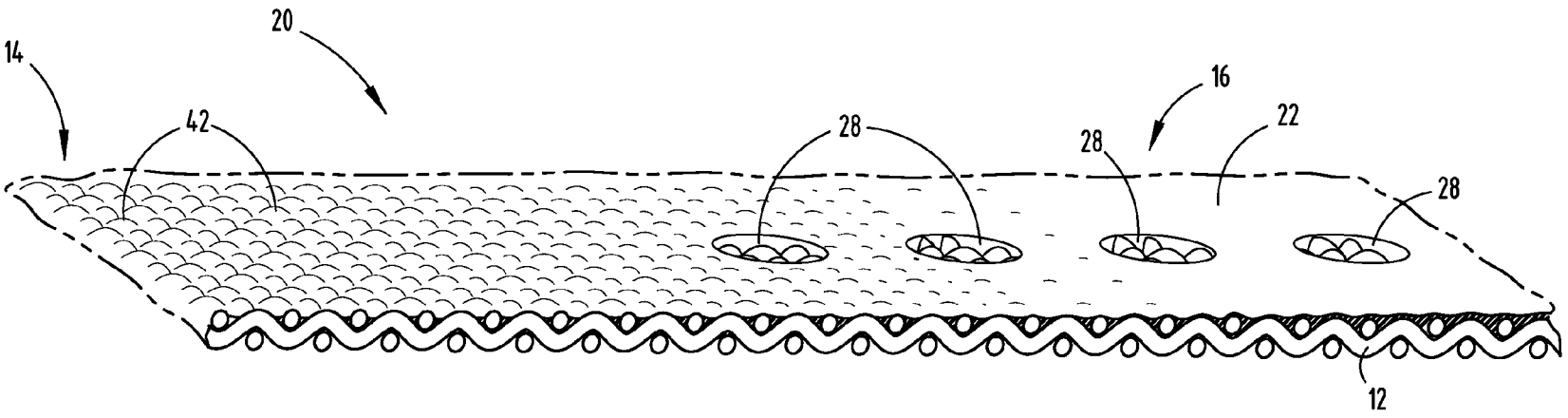
FIG. 4 is a top perspective view of a cross section taken at line IV-IV of FIG. 1.

As shown in more detail in FIG. 4, the thickness 24 of the polymeric coating 22 decreases in a gradual manner away from the palm side 20 of the hand portion 16 toward the cuff portion 14. In the illustrated embodiment, the thickness 24 of the polymeric coating 22 decreases in a generally linear manner between the hand portion 16 and the cuff portion 14 of the knit fabric hand shell 12. However, the thickness 24 deceases in a more rapid manner between the palm side 20 and the side surfaces 36 of the series of fingers 34, as shown in FIG. 3, to provide the desired decrease in the coefficient of friction of the side surfaces 36. Further, it is contemplated that the thickness 24 may decrease in an alternative manner (e.g. non-linear) from that illustrated between the palm side 20 and the back side 18 of the knit fabric hand shell 12.

As also illustrated in FIG. 4, the polymeric coating 22 adheres to the knit fabric hand shell 12 by generally embedding within the knit threads, wherein the thickness is defined as the amount of polymeric material accumulated away from the exterior surface of the knit threads. As the thickness of the polymeric coating 22 decreases, the polymeric coating begins to conform to the contour of the knit threads. Further, when the thickness of the polymeric coating decreases beyond the point where the contour of the polymeric coating conforms to the knit thread, some portions 42 of the outermost fibers of the knit fabric hand shell are slightly exposed. The exposed portions 42 of the outermost fibers have a lower coefficient of friction, such that the overall exterior surface of the glove proximate the decreasing polymeric coating has a decreased coefficient of friction relative to the portions entirely covered with the polymeric coating 22. The exposed portions 42 of the outermost fibers generally begin to occur with thicknesses less than 0.08 mm. Accordingly, the polymeric coating in the illustrated embodiment is configured to provide ventilation proximate the back side 18 of the hand portion 16 and to provide increased easy of movement for the series of fingers 34.

Referring again to the embodiment shown in FIG. 1, the plurality of perforations 28 are uniformly dispersed over the palm side 20 of the hand portion 14 in a predetermined pattern. More specifically, the plurality of perforations 28 in the illustrated embodiment is arranged in a square matrix that includes 45 rows of perforations and 39 columns of perforations. The 45 rows of perforations extend longitudinally from a tip portion 44 of a middle finger to a lower portion 46 of the palm area adjacent to the cuff portion 14 and the 39 columns of perforations extend laterally from the outer side surface 36 of a pinky finger 48 to the outer side surface 36 of the thumb 50. Generally, the square matrix of may include at least 10 rows of perforations and at least 10 columns of perforations, and more preferably at least 20 rows of perforations and at least 20 columns of perforations. In addition, it is conceivable that the perforations may be alternative dispersed over the palm side 20 of the hand portion 16.

Figure 5:
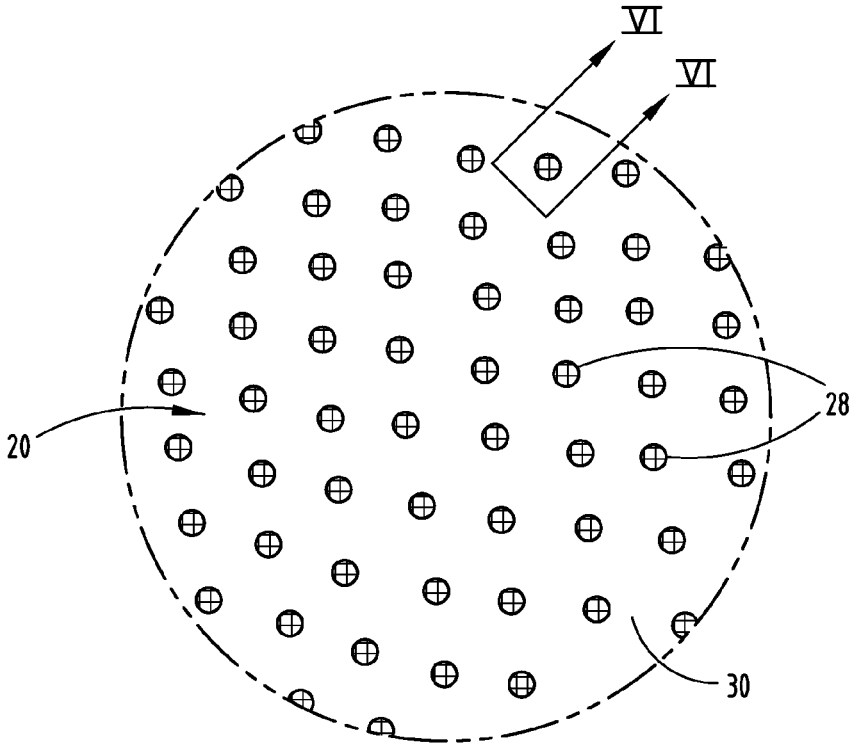
FIG. 5 is an enlarged section of the palm side of the protective glove taken at section V of FIG. 1.
Figure 6:
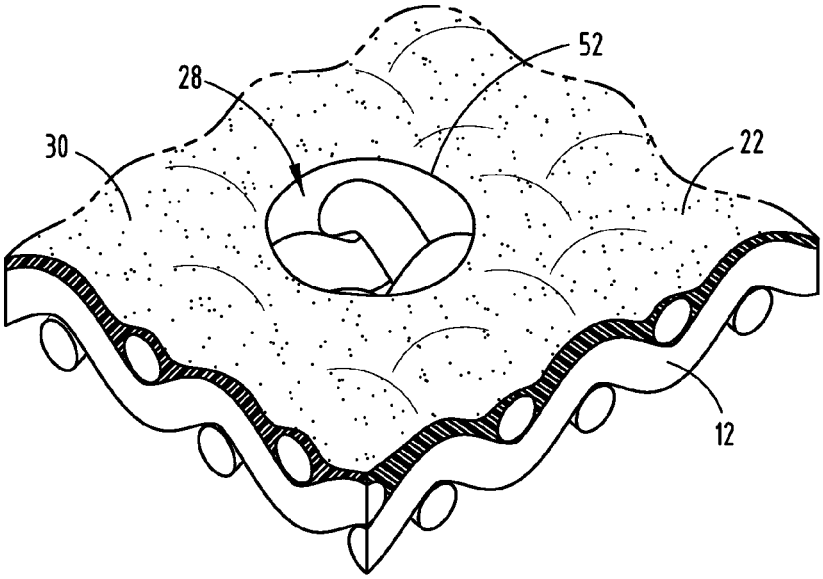
FIG. 6 is a top perspective view of a cross section taken at line VI-VI of FIG. 5.

As illustrated in the embodiment shown in FIGS. 5-6, the perforations 28 have a diameter of approximately 0.75 mm, such that the diameter of the perforations 28 are generally less than 1.2 mm, preferably less than 1 mm, preferably greater than 0.5 mm and more preferably between 0.8 mm and 0.7 mm. However, in additional embodiments the perforations 28 may vary in shape and size, including various shapes and sizes on a single protective glove 10. Generally, the holes 12 are sufficiently large in area to provide cooling and ventilation to the user's hand, but are sufficiently small that they do not diminish abrasion resistance, and the like. As further shown in the illustrated embodiment, the perforations 28 are cut to only extend though the polymeric coating 22, leaving the underlying knitted fabric intact to provide protection for the user's palm, but still provide breathability through the knit structure of the knit fabric hand shell 12. An edge portion 52 of the perforations also provides additional overall increase to the coefficient of friction for the exterior surface 30 of the polymeric coating 22.

Figure 7:
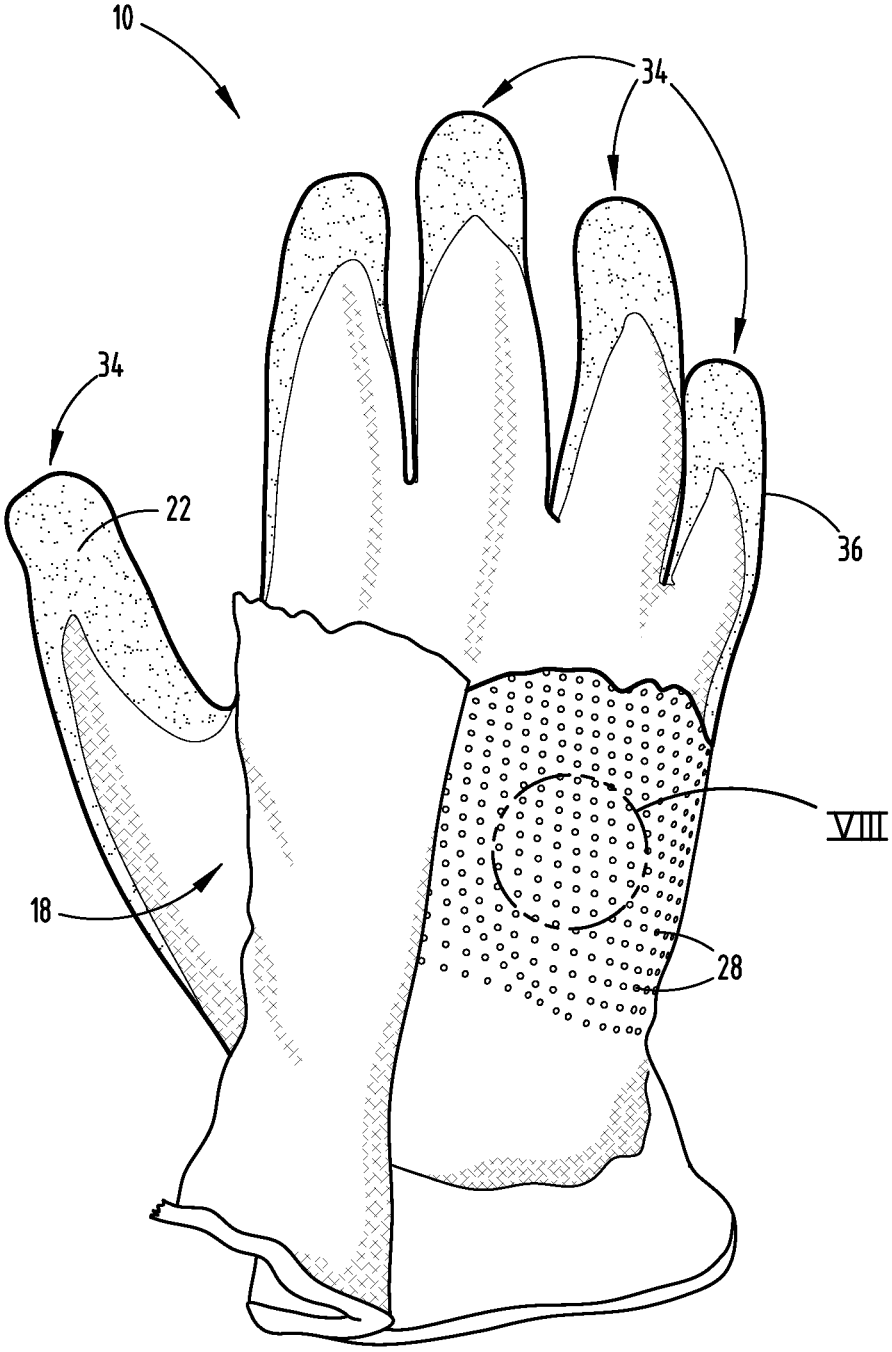
FIG. 7 is a rear elevational view of a back side of an additional embodiment of a protective glove with a portion of the back side cut away to show an interior surface of a palm area of the protective glove.
Figure 8:
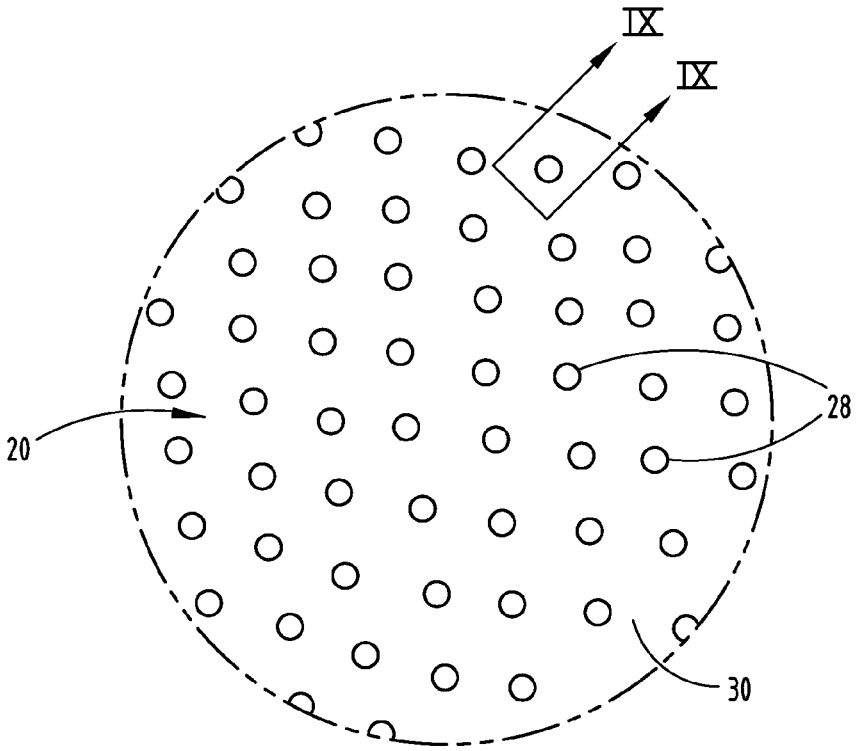
FIG. 8 is an enlarged section of the palm side of the additional embodiment of the protective glove taken at section VIII of FIG. 7.
Figure 9:
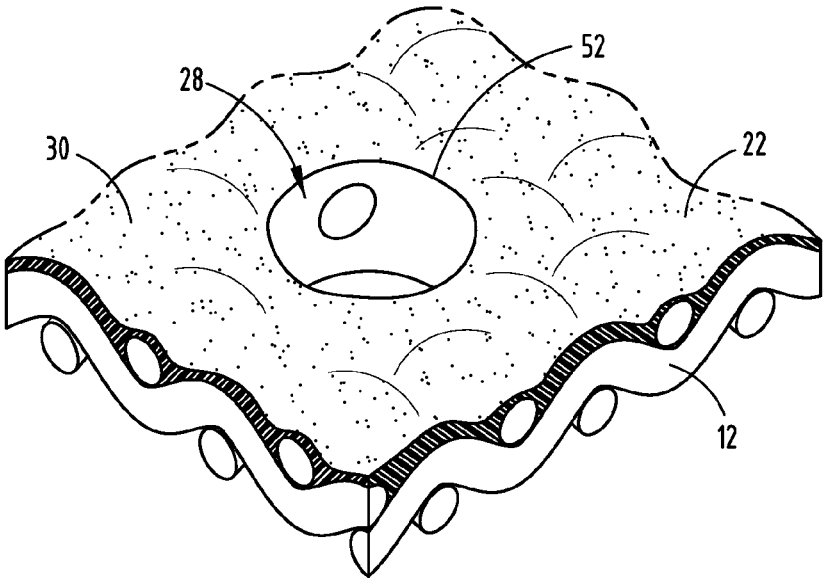
FIG. 9 is a top perspective view of a cross section taken at line IX-IX of FIG. 8.

An additional embodiment is illustrated in FIGS. 7-9, showing the perforations 28 extending through the knit fabric hand shell 12, as well as the polymeric coating 22. The plurality of perforations 28 in this embodiment is similarly arranged over palm side 20 through the series of fingers 34 and the palm area in a matrix arrangement, as described above. Also in this embodiment, the diameter of the perforations 28 are capable of being made smaller than the previously described embodiment, as the threads within the perforations 28 in the previous embodiment are capable of blocking ventilation through smaller holes. Such smaller diameter holes, in addition to providing ventilation, are also capable of providing a measure of protection against liquids, which may not be capable of easily passing through the smaller diameter holes.

Figure 10:
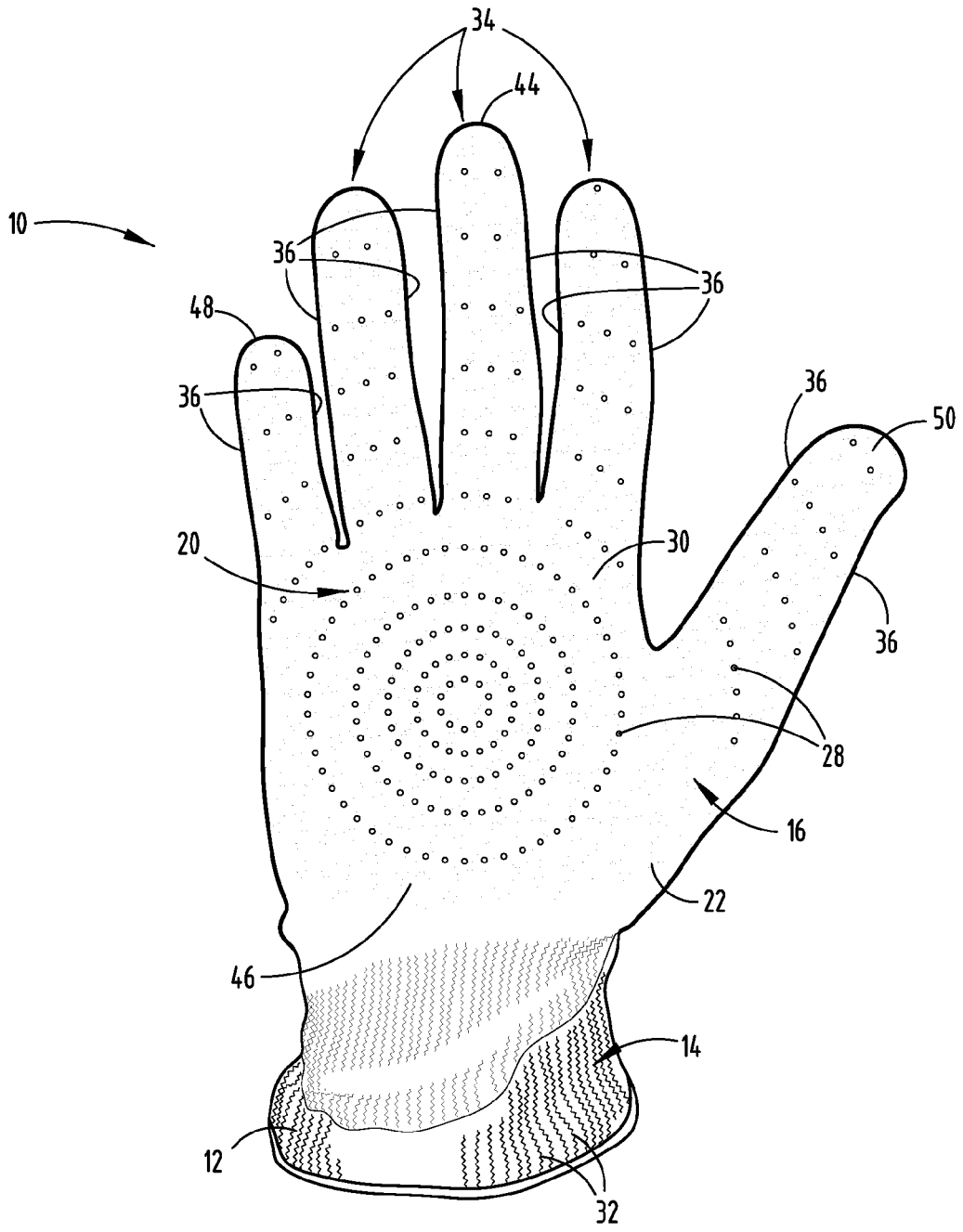
FIG. 10 is a front elevational view of an additional embodiment of a protective glove.

As further illustrated in FIG. 10, an additional embodiment includes an alternative predetermined pattern of the plurality of perforations 28. In this embodiment, the predetermined pattern is dispersed over the palm side 20 through the series of fingers 34 and the palm area in a pattern of circles with a smaller concentration of perforations as the radius of each circle increases. Accordingly, the perforations 28 are primarily focused proximate the center of the circles, which is positioned in the middle of the palm area in this embodiment. It is contemplated that a variety of predetermined patterns of perforations 28 may be cut though the polymeric coating 22, as long as the perforations 28 are sufficiently dispersed as not to compromise the abrasion resistance of the polymeric coating 22. The number of perforations and the overall area encompassed by the holes may vary as well. Overall, the size of the perforations, the number of perforations, and the overall area are selected to provide a balance between ventilation and abrasion resistance.

Figure 11:
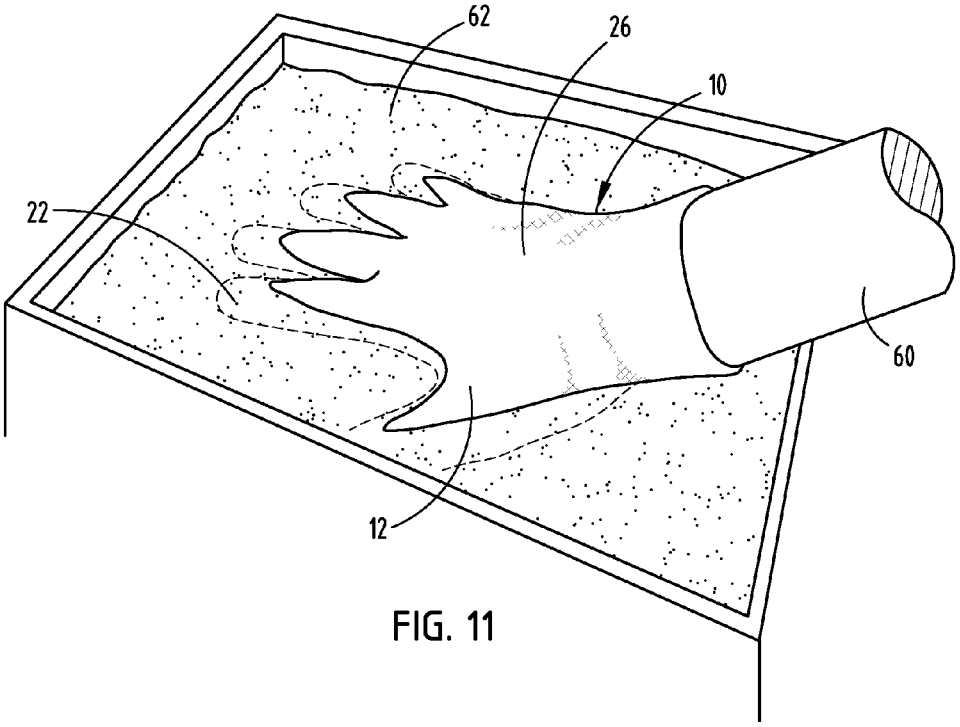
FIG. 11 is a top perspective view of an immersion stage of a dip coating process for one embodiment of making the protective glove.

To apply the polymeric coating 22 to the knit fabric hand shell 12, in one embodiment a dip coating process is employed. As shown in FIG. 11, the knit fabric hand shell 12 is placed over a three dimensional hand mold 60 and is then dipped into a liquid bath 62 containing the uncured polymeric material. The liquid bath 62 of polymeric material may comprises a nitrile rubber, polyurethane, PVC or natural rubber coating, or other comparable material. More specifically, in the embodiment illustrated in FIG. 1, the protective glove 10 includes a resulting overall fiber content of 60% nitrile, 39% nylon, and 1% elastic. It is contemplated that with varied thicknesses of the polymeric coating 22 and the fiber density of the knit fabric hand shell 12 that the overall fiber content may vary from the illustrated embodiment. The portion of the knit fabric hand shell 12 immersed into the liquid bath 62 begins to bond with the polymeric material. The longer the knit fabric hand shell is immersed or more times dipped will allow the resulting thickness of the polymeric coating to increase. Accordingly, the palm side 20 is immersed in the liquid bath 62 longer than the side surfaces 36 of the series of fingers to provide the polymeric coating 22 shown in FIG. 3. Upon collecting the sufficient amount polymeric material on the knit fabric hand shell 12, the glove 10 is sent through an oven drying station for drying and final curing. It is conceivable that in broader aspects of the invention additional portions of the knit fabric hand shell may be coated with the polymeric coating, such as a three-quarter dip coating or a full dip coating. For instance, the dip coating process may be used to the three-quarter dip, which covers the series of fingers up to the first knuckle, and a full dip, which covers the back side of the hand portion completely.

Figure 12:
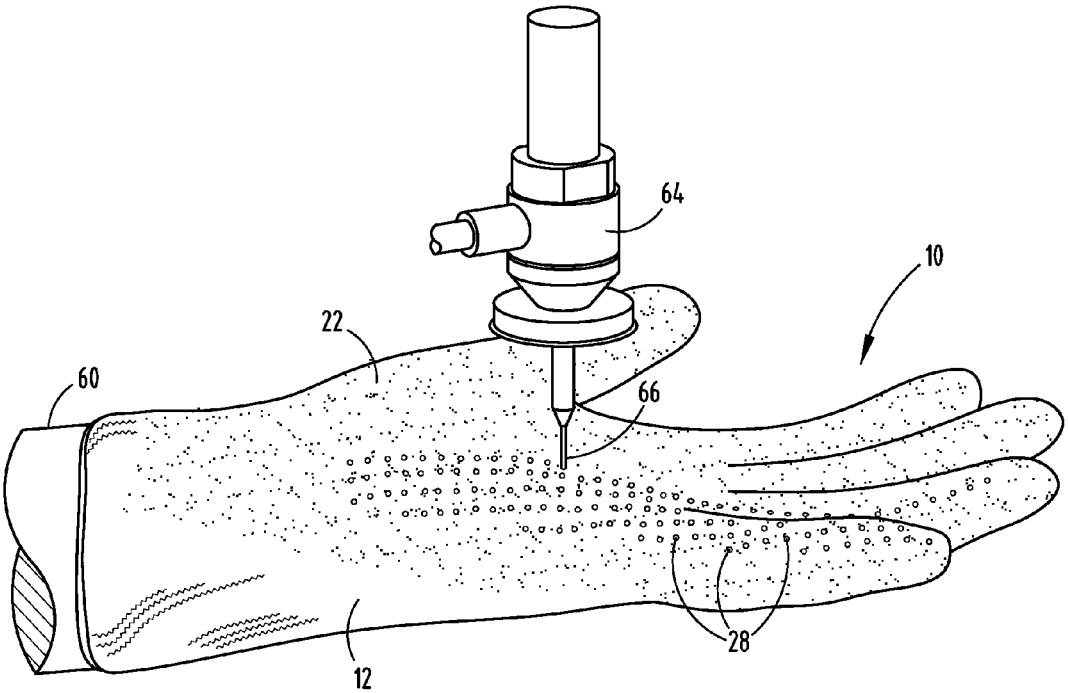
FIG. 12 is a top perspective view of a cutting stage of a water jet cutting process for one embodiment of making the protective glove.

After the polymeric coating 22 is applied, the perforations 28 are cut through the polymeric coating 22, as shown in FIG. 12. In the illustrated cutting process, a water jet cutting machine 64 is employed to use high pressure water 66 to cut the perforations. This method is preferable to cut perforations that do not extend through the knit fabric hand shell 12, as the high pressure water 66 may be adjusted to cut the polymeric material 22 and merely pass by the threads of the knit fabric hand shell 12. The water jet cutting machine 64 may be automated to cut the predetermined pattern without the need for adjusting the glove or hand mold. The perforations 28 can also be made using a variety of other methods including a laser cutting machine or a mechanical die cutting machine. Laser cutting may be preferable for cutting perforations though both the polymeric coating 22 and the knit fabric hand shell 12. Laser cutting may also be used for cutting fabrics into panels or sections that are sewn or otherwise affixed together to make other embodiments of the hand shell. Laser cutting heats and singes the cut ends of the knit and/or woven fabric so there is less chance of unraveling of the glove structure and also eliminates the need to clean away debris.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structure without departing from the concepts of the present invention, and further it is to be understood that such concepts are intended to be covered by the following claims unless these claims by their language expressly state otherwise.

We claim:

1. A protective glove comprising:

a knit fabric hand shell having a cuff portion and a hand portion seamlessly knit together, wherein the cuff portion includes an elastic material configured to provide a secure fit around a wrist of a user and the hand portion includes a back side opposite a palm side configured to cover opposing sides of a hand of a user;

a polymeric coating covering the palm side of the hand portion and having a thickness that gradually diminishes from the palm side to the back side of the hand portion, wherein the back side of the hand portion has an area that is free of the polymeric coating to provide ventilation to the user's hand through the knit fabric hand shell; and a plurality of perforations dispersed over the palm side of the hand portion in a plurality of circular patterns, with the majority of perforations being proximate an intermediate area of the palm side, wherein the perforations have a diameter less than 0.2 millimeters and extend though the polymeric coating to provide ventilation to the user's hand and to increase a coefficient of friction of an exterior surface of the polymeric coating.

2. The protective glove of claim 1, wherein the hand portion of the knit fabric hand shell includes a series of fingers that each have a side surface between the palm side and the back side, and wherein the thickness of the polymeric coating decreases from a first depth proximate the palm side to a second depth proximate the side surface for allowing the series of fingers to slidably move relative to each other with reduced friction.

3. The protective glove of claim 2, wherein the thickness of the polymeric coating decreases from the second depth proximate the side surface to the area that is free of the polymeric coating on the back side of the hand portion.

4. The protective glove of claim 2, wherein the first depth of the thickness of the polymeric coating on the palm side is less than 0.3 millimeters.

5. The protective glove of claim 1, wherein the hand portion of the knit fabric hand shell includes a series of fingers and a palm area, and wherein the polymeric coating and the plurality of perforations are dispersed over the series of fingers and the palm area.

6. The protective glove of claim 1, wherein the plurality of perforations extend through the polymeric coating and the knit fabric hand shell.

7. The protective glove of claim 1, wherein the knit fabric hand shell is comprised of a select one or any combination of cotton fibers, aramid fibers, polyurethane fibers, polyamide fibers, high-density polyethylene fibers, ultra high molecular weight polyethylene fibers, and glass fibers.

8. The protective glove of claim 7, wherein the polymeric coating is comprised of a select one or any combination of nitrile rubber, polyurethane, and PVC.

* * * * *